US009318855B2

(12) United States Patent
Miyakawa

(10) Patent No.: US 9,318,855 B2
(45) Date of Patent: Apr. 19, 2016

(54) CONNECTOR

(71) Applicant: Yazaki Corporation, Tokyo (JP)

(72) Inventor: Daisuke Miyakawa, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/790,470

(22) Filed: Jul. 2, 2015

(65) Prior Publication Data

US 2016/0020564 A1 Jan. 21, 2016

(30) Foreign Application Priority Data

Jul. 17, 2014 (JP) ..... 2014-146889

(51) Int. Cl.

| | |
|---|---|
| ***H01R 13/40*** | (2006.01) |
| ***H01R 24/38*** | (2011.01) |
| ***H01R 13/422*** | (2006.01) |
| *H01R 13/436* | (2006.01) |
| *H01R 107/00* | (2006.01) |

(52) U.S. Cl.

CPC ..... *H01R 24/38* (2013.01); *H01R 13/4223* (2013.01); *H01R 13/4362* (2013.01); *H01R 2107/00* (2013.01)

(58) Field of Classification Search

USPC ..... 439/595

See application file for complete search history.

(56) References Cited

U.S. PATENT DOCUMENTS

| | | | | |
|---|---|---|---|---|
| 4,565,416 | A * | 1/1986 | Rudy | H01R 13/4364 439/592 |
| 4,714,437 | A * | 12/1987 | Dyki | H01R 13/4364 439/595 |
| 4,971,579 | A * | 11/1990 | Mobley | H01R 13/4361 439/592 |
| 7,387,545 | B2 * | 6/2008 | Tyler | H01R 13/4365 439/595 |
| 8,408,950 | B2 * | 4/2013 | Jeon | H01R 13/4365 439/595 |

FOREIGN PATENT DOCUMENTS

JP 2004-273374 A 9/2004

* cited by examiner

*Primary Examiner* — Tho D Ta
(74) *Attorney, Agent, or Firm* — Locke Lord LLP

(57) ABSTRACT

A connector having a housing is disclosed. The housing of the connector includes a receiving chamber group having four terminal receiving chambers in which a terminal is inserted, and a lance body surrounded by the four terminal receiving chambers. Each of the four terminal receiving chambers is arranged so that each axis thereof is positioned in four vertexes of a square. The lance body integrally has four flexible lances arranged corresponding to each four terminal receiving chambers. Each of the four flexible lances has a locking portion. Further, each the four flexible lances is arranged in a diagonal line so that the free end is bent in a diagonal direction of the square when inserting/extracting the terminal into the terminal receiving chamber and the locking portion is locked or unlocked on the step of the terminal.

4 Claims, 9 Drawing Sheets

CONNECTOR

TECHNICAL FIELD

The present invention relates to a connector arranged in a terminal of a wire harness.

BACKGROUND OF THE INVENTION

Various electronic devices are mounted on a vehicle as a moving object. Those electronic devices are connected with a wire harness so as to transmit electric power or control signal between them. The wire harness has an electric wire bundle in which a plurality of electric wires are bundled, and a connector attached to the terminal of the electric wire bundle. (For example, see Patent Document 1). Also, many of connector has a structure including a terminal of which a mating terminal is fitted to one end and an electric wire is connected to the other end, and a housing receiving a plurality of the terminals.

FIG. 9 shows the structure of a conventional connector as an example. In the connector 500 shown in FIG. 9, a terminal 520 is housed in a cylindrical-shaped terminal receiving chamber 511 arranged in a housing 510 in a state that the terminal 520 is retained. The retaining of the terminal 520 is performed by a flexible lance 512 arranged in the housing 510. The flexible lance 512 is positioned adjacent to the terminal receiving chamber 511, extends in a longitudinal direction of the terminal receiving chamber 511, and is a flexible member. One end of the flexible lance 512 is a free end. A part of the flexible lance 512 at the free end side is a locking portion 512*a* projecting into the inside of the terminal receiving chamber 511 so that the part of the flexible lance 512 is locked on the terminal 520 in the terminal receiving chamber 511 and retained. When inserting the terminal 520 into the terminal receiving chamber 511 or when extracting from the terminal 520 after inserted into the terminal receiving chamber 511, the flexible lance 512 is bent to the outside of the terminal receiving chamber 511, and the locking portion 512*a* is locked or unlocked on the terminal 520. Furthermore, the tip of the terminal 520 in the terminal receiving chamber 511 is supported with a front holder 530 attached to the housing 510.

Also, in the connector 500 shown in FIG. 9, two flexible lances 512 are arranged adjacent to two terminal receiving chambers 511, respectively, and integrally formed at the end portion of the right side in FIG. 9. Further, two flexible lances 512 are located in a back-to-back position so that two flexible lances 512 are bent in a mutually approaching direction when inserting or extracting the terminal 520. Two flexible lances 512 are formed in the back-to-back, and thereby a space between two terminal receiving chambers 511 can be shorted. As a result, the size of the connector 500 can be reduced.

CITATION LIST

Patent Literature

Patent document 1: Japanese Patent Application Publication No. 2004-273374

SUMMARY OF THE INVENTION

Recently, further miniaturization of a connector used for a wire harness is required, and it is difficult to meet such requirements with the structure as described with reference to FIG. 9.

Accordingly, an object of the present invention is to provide a connector with further downsizing.

In order to attain the above object, a connector of the present invention has a large-diameter portion and a small-diameter portion formed in cylindrical shape and continued in an axial direction; and a housing for receiving a plurality of the terminals. The housing has a receiving chamber group including four terminal receiving chambers extending from one end of the housing toward the other end thereof and in which the terminal is inserted with the large-diameter portion as a leading end from an opening provided in the other end; and a lance body arranged to be surrounded by the four terminal receiving chambers. Each of the four terminal receiving chambers of the receiving chamber group is arranged so that each axis of the terminal receiving chambers is parallel to each other and is located on four vertexes of a square or rectangle when viewing from the axis direction. The lance body is arranged corresponding to each the four terminal receiving chambers and integrally has four flexible lances extending in a longitudinal direction of the terminal receiving chamber, one end of each the flexible lance is formed to be a free end in the one end of the housing. Each the four flexible lances has a locking portion projecting into an inside of the terminal receiving chamber so as to be locked on a step between the large-diameter portion and the small-diameter portion in the terminal received in the corresponding terminal receiving chamber. Further each the four flexible lances is located in a diagonal line of the square or rectangle so that the free end is bent in a diagonal direction of the square or rectangle and the locking portion is locked or unlocked on the step when the terminal is inserted in the terminal receiving chamber or extracted therefrom.

Preferably, according to a second aspect, the free end of the flexible lance extends toward the one end of the housing over the step, and supports the large-diameter portion in the diagonal direction.

Preferably, according to a third aspect, a plurality of the receiving chamber groups are provided. One of the plurality of the receiving chamber groups and the other of the plurality of the receiving chamber groups are arranged opposite to each other with a space in one direction. The axis of the terminal receiving chamber of the one of the plurality of the receiving chamber groups and the axis of the terminal receiving chamber of the other of the plurality of the receiving chamber groups are arranged so as to be shifted in a direction perpendicular to the one direction.

According to the present invention, the lance body integrally has the four flexible lances bent in the diagonal direction of the square or rectangle. Thereby, spaces between the four terminal receiving chambers which surround the lance bodies in the vertical and horizontal two directions in the receiving chamber group can be reduced. As a result, the housing can be downsized, and thereby the connector can be more downsized.

Further, according to the present invention, the free end of the flexible lance extends toward the one end of the housing over the step. For this reason, when the two flexible lances located in a face-to-face position are bent in the diagonal direction, the free ends extending as mentioned above abuts on each other between the two flexible lances. By the abutment, excessive flexure of the flexible lance can be restricted. Furthermore, since the free end extending in this way supports the large-diameter portion of the terminal, another member for supporting the terminal such as the front holder 530 shown in FIG. 9 is not required, and thereby a number of parts can be reduced.

Further, according to the present invention, the axis of the terminal receiving chamber of the one of the plurality of the receiving chamber groups and the axis of the terminal receiving chamber of the other of the plurality of the receiving chamber groups are arranged so as to be shifted in a direction perpendicular to the one direction. As a result, spaces between them in the one direction can be reduced, and thereby the connector can be more downsized.

Also, a connector which is mounted on an edge of a substrate and is fitted in a substrate surface direction is considered as a mating connector. In many of such type of the connectors, one side opposite to the other side fitted to the terminal is a connecting pin. The connecting pin extends parallel to the substrate, is bent at 90 degrees, and then is connected to the substrate. At this time, it is assumed that the terminal is arranged in lattice points. In this case, since the connecting pin extending from the terminal is arranged parallel to each other and is connected to the substrate through a path, a connecting point on the substrate is arranged in the lattice points and an area on the substrate is occupied by the amount of the sequence.

On the other hand, according to the present invention, the horizontal direction parallel to the substrate is adopted as a direction shifting the axis of the terminal receiving chamber. So, the terminal in the mating connector can be arranged as below. More specifically, in response to the terminal receiving chamber of one of the plurality of the receiving chamber groups and the other of the plurality of the receiving chamber groups, the terminal arranged opposite to each other with a space in the vertical direction can be arranged so as to be shifted in the horizontal direction. Thus, the connecting point of the connecting pin extending from the terminal on the substrate can be arranged side by side in a row without a space in the vertical direction. As a result, the occupied area on the substrate can be reduced. The above and other objects and features of this invention will become more apparent from the following description taken in conjunction with the accompanying drawings.

BRIEF DESCRIPTION OF THE DRAWINGS

FIG. 4A shows a housing of a comparison example against a housing of the present invention according to the first embodiment;

FIG. 4B shows a housing of the present invention according to the first embodiment;

DESCRIPTION OF THE PREFERRED EMBODIMENT (First Embodiment)

Figure 1:
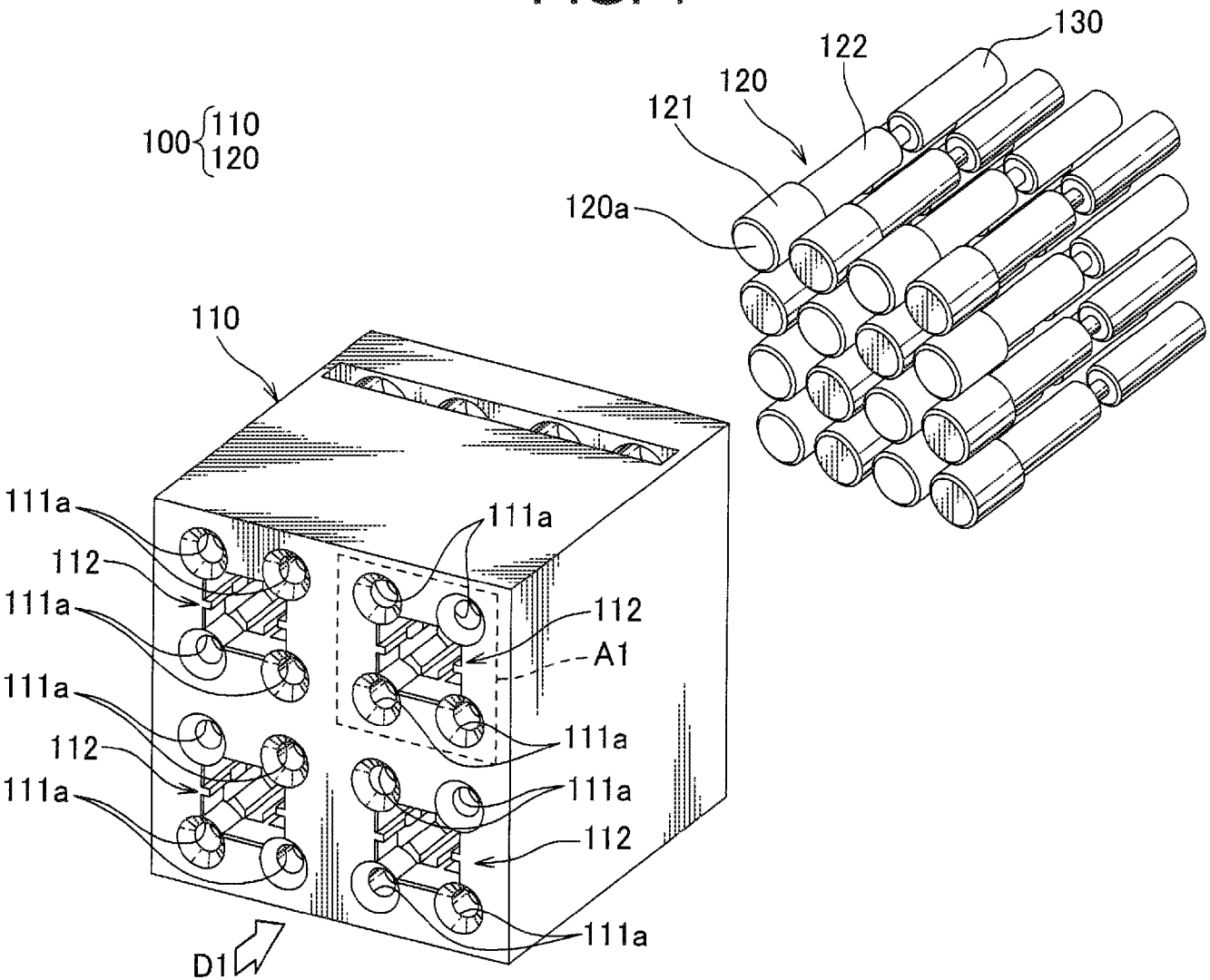
FIG. 1 is a perspective view showing a connector which is divided into a housing and a round terminal according to first embodiment.
Figure 2:
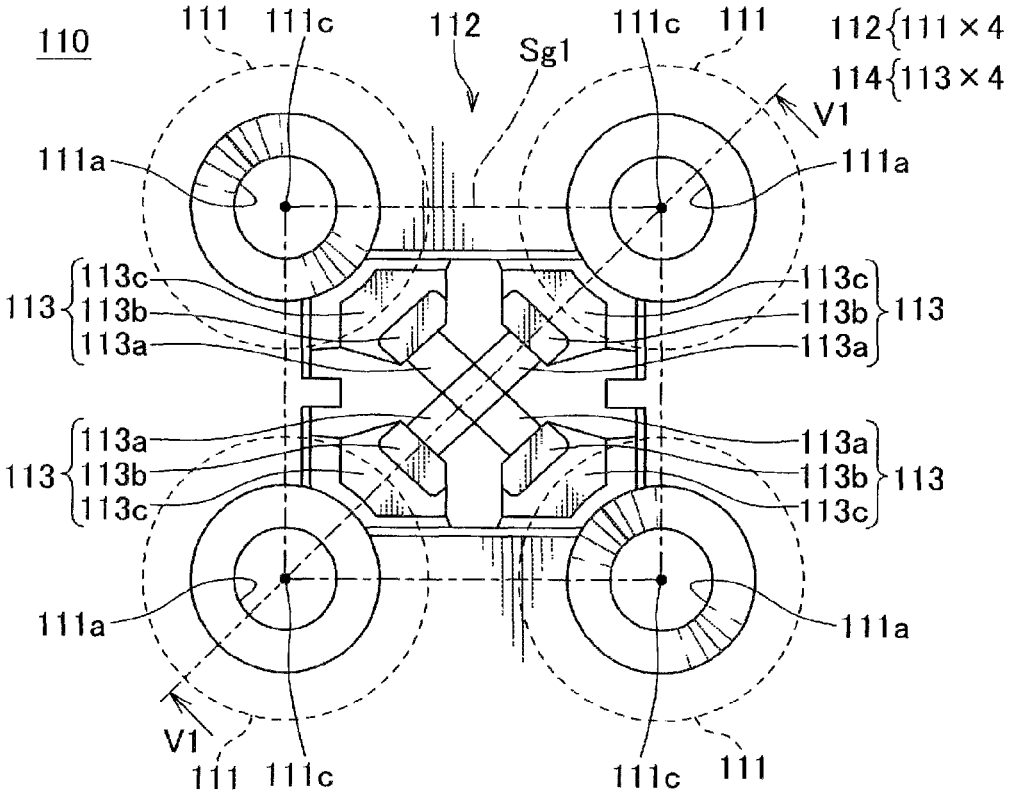
FIG. 2 is an enlarged front view of an area A1 in FIG. 1 when viewed in a direction of arrow D1.
Figure 3:
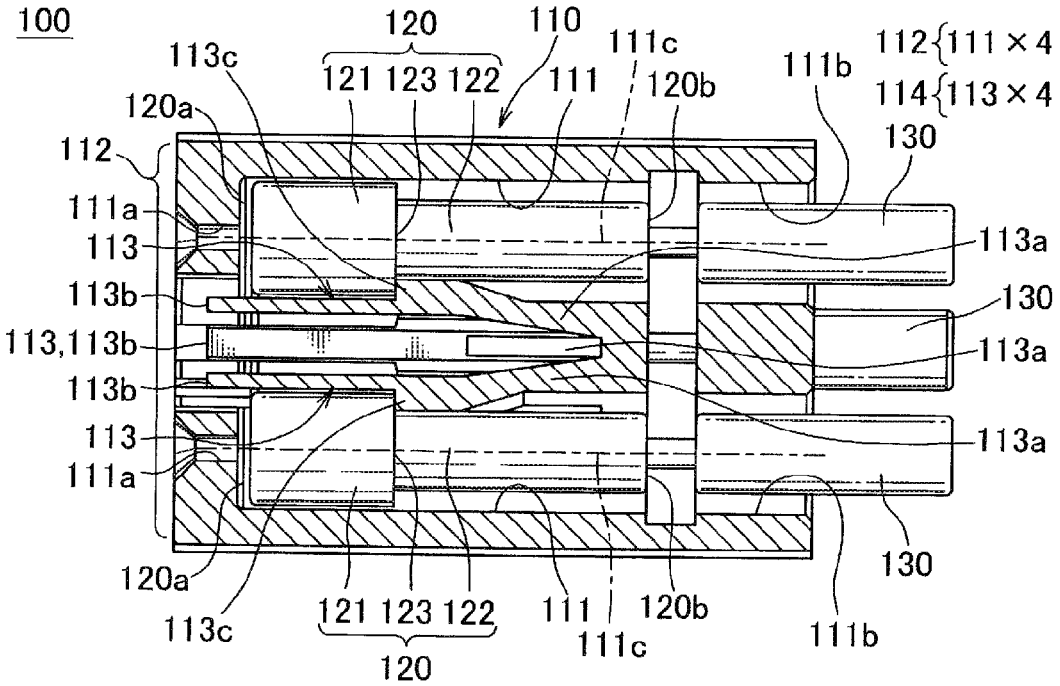
FIG. 3 is a cross-sectional view of the housing and the round terminal received in the housing taken along the V1-V1 in FIG. 2.

A connector according to first embodiment of the present invention will be explained with reference to FIGS. 1 to 4. The connector 100 of the first embodiment has a quadrangular-shaped housing 110 and a round terminal 120 (terminal). FIG. 1 shows a perspective view of the connector 100 which is separated into the housing 110 and the round terminal 120 of the first embodiment of the present invention. FIG. 2 shows an enlarged front view of an area A1 in FIG. 1 when viewing in a direction of arrow D1. FIG. 3 shows a cross-sectional view of the housing 110 taken along V1-V1 of FIG. 2 together with the round terminal 120 received in the housing 110.

As shown in FIGS. 1 to 3, the round terminal 120 is formed in cylindrical shape, and is a female terminal. A mating male terminal not shown is fitted to one end 120*a* of the round terminal 120, and an electrical wire 130 is connected to the other end 120*b* thereof. Further, the one end 120*a* of the round terminal 120 is a large-diameter portion 121, and the other end 120*b* is a small-diameter portion 122.

The housing 110 receives sixteen round terminals 120. As shown in FIG. 3, the housing 110 includes sixteen terminal receiving chambers 111 which respectively receive the round terminal 120. Each terminal receiving chamber 111 extends from one end of the housing 110 to the other end thereof, and is formed in a cylindrical shape. Further, each terminal receiving chamber 111 has a fitting hole 111*a* for fitting the mating male terminal and a insertion/extraction hole 111*b* for inserting/extracting the round terminal 120. The fitting hole 111*a* is opened in the one end of the housing 110, and the insertion/extraction hole 111*b* is opened in the other end thereof.

In the housing 110, four terminal receiving chambers 111 are arranged, and constitute a receiving chamber group 112. The receiving chamber group 112 is arranged so that each the axis 11*c* is parallel to each other and is positioned at the four corners of a square Sg1. Four the receiving chamber groups 112 are provided in the housing 110.

As shown in FIGS. 2 and 3, a lance body 114 is arranged in an area surrounding by four terminal receiving chambers 111 in each the receiving chamber group 112. The lance body 114 integrally has four flexible lances 113 for retaining the round terminal 120 in each the terminal receiving chamber 111. Each the flexible lance 113 is located close to the terminal receiving chamber 111 on the center side of the square Sg1 and extends in a longitudinal direction of the terminal receiving chamber 111. Further, the flexible lance 113 has a fixed end 113*a* which is provided on the insertion/extraction hole 111*b* side of the terminal receiving chamber 111, and a free end 113*b* which is provided on the fitting hole 111*a* side. Furthermore, a part of the flexible lance 113 is a locking portion 113*c* projecting into the terminal receiving chamber 111. The locking portion 113*c* is locked on a step 123 between the large-diameter portion 121 and the small-diameter portion 122 on the round terminal 120 in the terminal receiving chamber 111, and thereby it serves as a stopper.

Each of the four flexible lances 113 is placed diagonally to the square Sg1 so that the free end 113*b* is bent in a diagonal direction of the square Sg1 and the locking portion 113*c* is locked or unlocked on the step 123 when inserting/extracting the round terminal 120 in the terminal receiving chamber 111. More specifically, when inserting the round terminal 120, the locking portion 113*c* is retracted from the terminal receiving chamber 111, the large-diameter portion 121 passes through the locking portion 113*c* in the terminal receiving chamber 111, and the locking portion 113*c* is locked on the step 123 after the large-diameter portion 121 passes through the locking portion 113*c*. Further, when extracting the round terminal 120, the locking portion 113*c* is retracted from the terminal receiving chamber 111, and engagement of the locking portion 113*c* and the step 123 is canceled.

According to the first embodiment of the present invention, the four flexible lances 113, which are respectively arranged in the four terminal receiving chamber 111 forming the receiving chamber group 112, are integrally formed on the fixed end 113*a*. Thereby, the lance body 114 consisting of the four flexible lances 113 is radially branched toward each the vertex of the square Sg1, and is formed with a structure that the tip of each branch becomes the free end 113*b*. Furthermore, each the free end 113*b* of two flexible lances 113 is arranged in a diagonal line of the square Sg1. The two flexible lances 113 are bent in a direction approaching to each other when inserting/extracting the round terminal 120, and are located on a back-to-back position, and are a pair.

According to the first embodiment of the present invention, the miniaturization of the housing 110 can be achieved by the structure of four flexible lances 113 in the lance body 114, and thereby it is possible to reduce the size of the connector 100. FIG. 4 is a view showing a state that the miniaturization of the housing 110 is achieved by the structure of four flexible lances 113 in the lance body 114. FIG. 4A shows a comparative example housing 610, and FIG. 4B shows the housing 110 of the first embodiment of the present invention.

Figure 9:
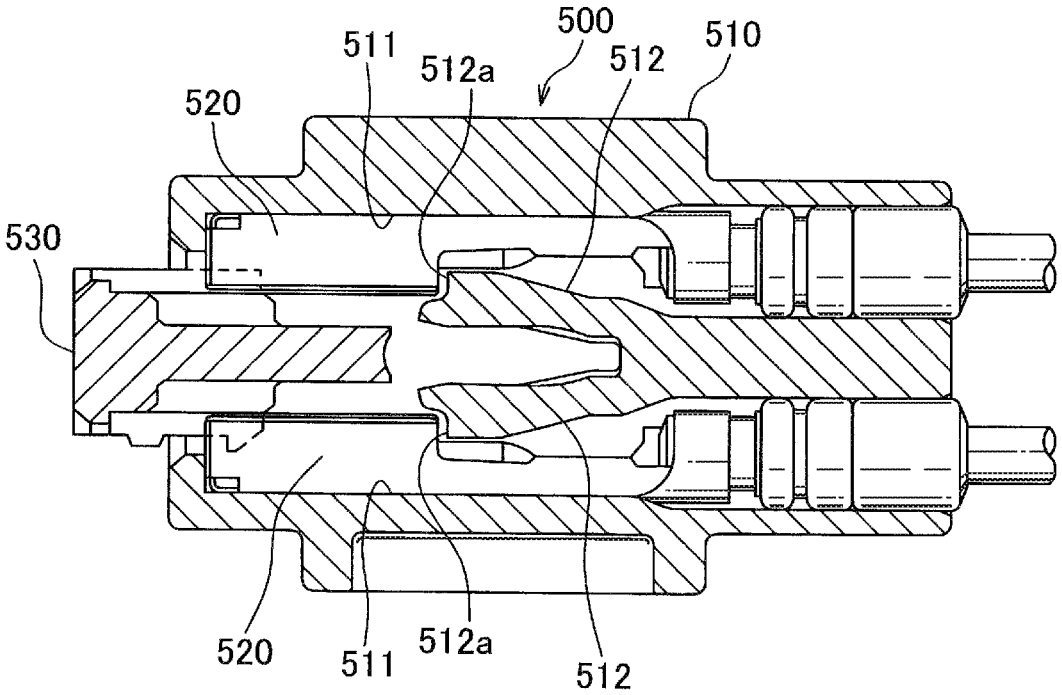
FIG. 9 PRIOR ART

The comparative example housing 610 shown in FIG. 4A, as described with reference to FIG. 9, is formed so that two flexible lances 612 which are respectively arranged close to two terminal receiving chambers 611 arranged in a vertical direction of FIG. 4A are located in a back-to-back position. In the comparative example housing 610, a space between the terminal receiving chambers 611 is shortened in the vertical direction of FIG. 4A since two flexible lances 612 are formed with a back-to-back positional relation. On the other hand, regarding to a horizontal direction of FIG. 4A, a space Ar1 is required so as to arrange the flexible lance 612, and a space W1 between the terminal receiving chambers 611 includes the space Ar1.

Figure 4B:
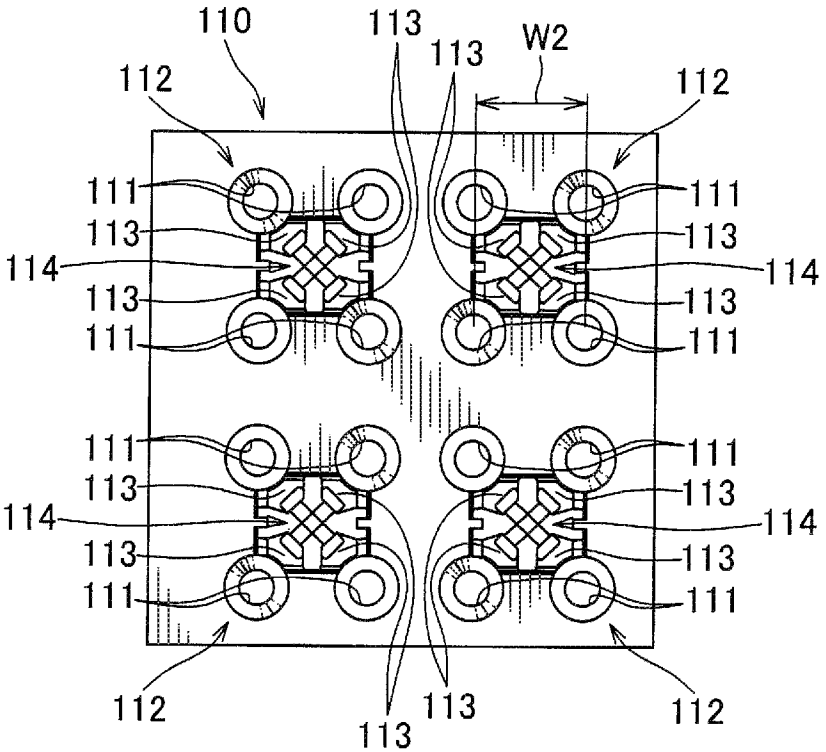
FIGS. 4A and 4B are views showing a state that miniaturization of the housing can be achieved by the structure of a flexible lance.
Figure 4A:
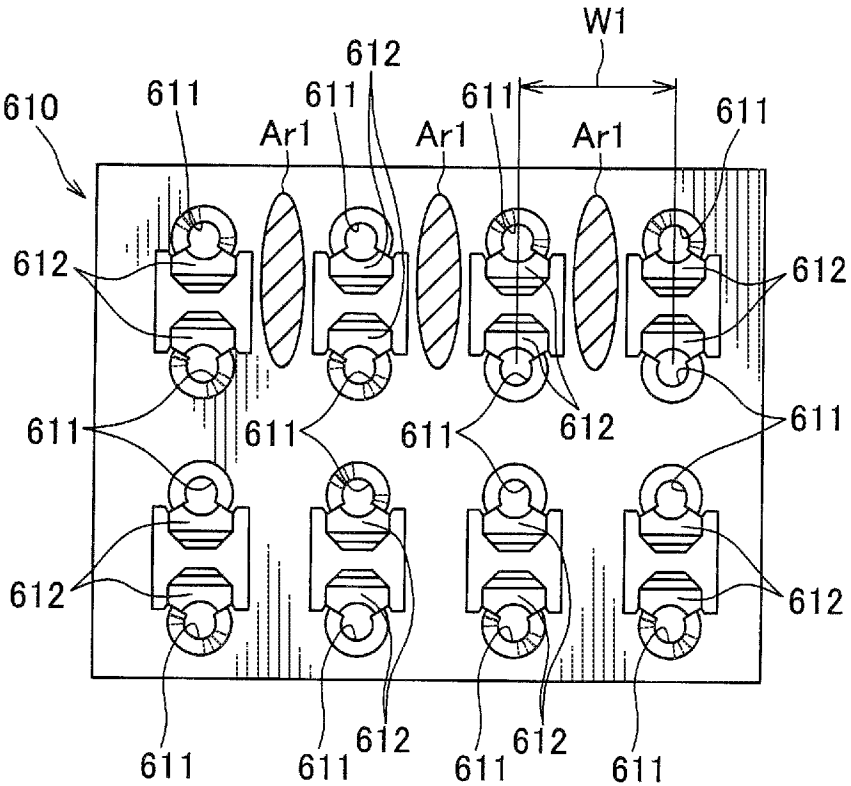

In contrast, the housing 110 of the first embodiment of the present invention shown in FIG. 4B has the lance body 114 surrounded in four terminal receiving chambers 111 forming the receiving chamber group 112. Four flexible lances 113 of the lance body 114 are integrally formed so that a pair of the flexible lances 113 on the diagonal line of the square Sg1 is bent back-to-back. For this reason, in the housing 110 of the present invention, the space Ar1 shown in FIG. 4A is not required in the horizontal direction of FIG. 4B. Further, the housing 110 of the present invention can reduce a space between two terminal receiving chambers 111 in the diagonal line of the square Sg1, and each space between four terminal receiving chambers 111 in the vertical and horizontal two directions. As a result, a space W2 between the terminal receiving chambers 111 is shorter than the space W1 shown in FIG. 4A. Thus, according to the present invention, each of the space between the terminal receiving chambers 111 forming the receiving chamber group 112 can be reduced in the two directions in height and width. Thereby the housing 110 can be downsized, and the connector can be more downsized.

Also, in the first embodiment of the present invention, as shown in FIG. 3, the locking portion 113*c* for performing a function as retaining by locking on the step 123 of the round terminal 120 is located near the center of the flexible lance 113. The free end 113*b* of each flexible lance 113 extends in the fitting hole 111*a* side beyond the step 123, and supports the large-diameter portion 121 of the round terminal 120 in a diagonal direction of the square Sg1.

For this reason, when two flexible lances 113 located in a face-to-face position in the diagonal direction are bent, the free ends 113*b* extending as mentioned above abut on each other between two flexible lances 113. By the abutment, excessive flexure of the flexible lance 113 can be restricted. Furthermore, since the free end 113 extending in this way supports the large-diameter portion 121 of the round terminal 120 as shown in FIG. 3, another member such as the front holder 530 shown in FIG. 9 is not required, and thereby a number of parts can be reduced.

(Second Embodiment)

Next, a connector 210 according to second embodiment of the present invention will be explained with reference to FIGS. 5 to 8. The connector of the second embodiment of the present invention is equal to the connector 100 of the first embodiment of the present invention except for the arrangement of the terminal receiving chamber 111 in the housing. The connector of the second embodiment will be explained by focusing on differences from the connector 100 of the first embodiment in the following.

Figure 5B:
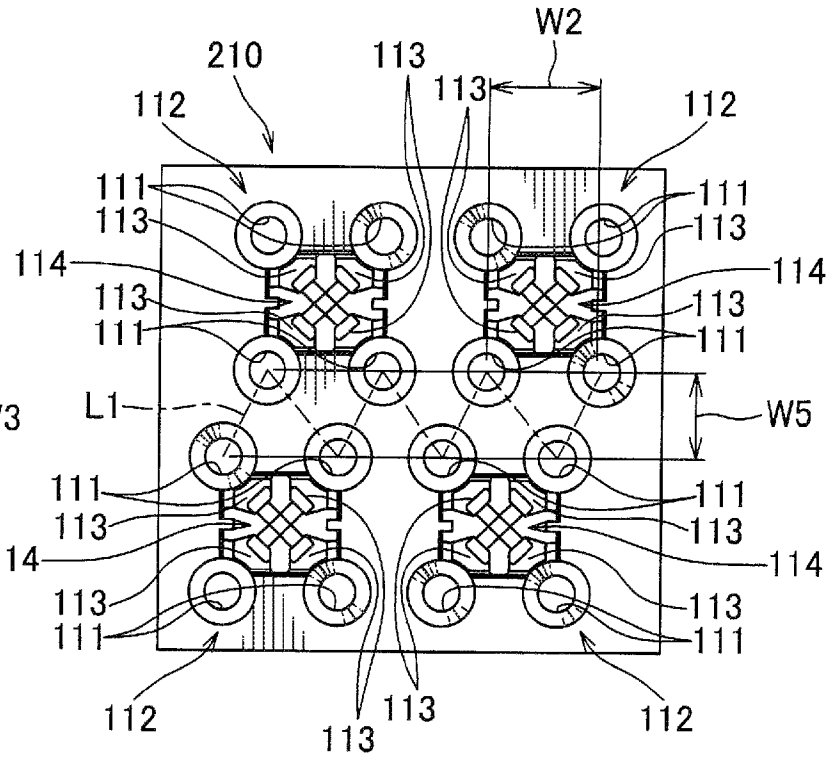
FIG. 5B shows a housing of the present invention according to the second embodiment.
Figure 5A:
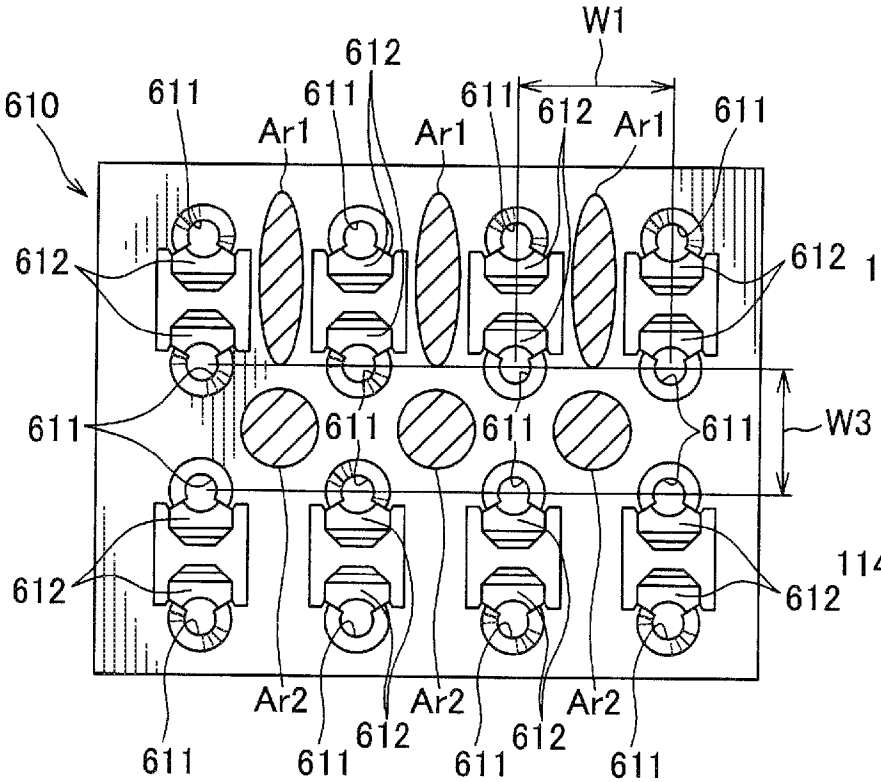
FIG. 5A shows a housing of a comparison example against a housing of the present invention according to second embodiment.

FIG. 5 is a view showing the housing of the connector of the second embodiment in the present invention together with the comparative example housing 610 shown in FIG. 4A. FIG. 5A shows the comparative example housing 610, and FIG. 5B shows the housing 210 of the second embodiment of the present invention. Also, regarding components of FIG. 5 equivalent to components shown in FIG. 4, the same reference number as components of FIG. 4 are designated, and explanation of the same components as FIG. 4 is omitted.

As shown in FIG. 5B, in the housing 210, one receiving chamber group 112 and the other receiving chamber group 112 are placed opposite to each other with a space in a vertical direction of FIG. 5. Further, the axis 111*c* (see FIG. 2) of the terminal receiving chamber 111 of the one receiving chamber group 112 and the axis of 111*c* of the terminal receiving chamber 111 of the other receiving chamber group 112 are dislocated in the horizontal direction of FIG. 5 perpendicular to an opposing direction. For this reason, the terminal receiving chamber 112 is arranged so that the terminal receiving chambers 111 located in the center of the housing 210 are arranged in a zigzag alignment (dashed line L1) in the horizontal direction with a space between the receiving chamber groups. As a result, a space W5 between the receiving chamber groups 112 in the width direction (namely, the vertical direction in FIG. 5) of the zigzag alignment can be reduced as mentioned below.

As shown in FIG. 5A, in the housing 610 of the comparison example, a space W3 between the terminal receiving chamber 612 provided at two stages in an upper side of FIG. 5A and the terminal receiving chamber 612 provided at two stages in a lower side of FIG. 5A is provided so that spaces Ar2 for separating the terminal receiving chambers 612 in the vertical direction are sandwiched between them. On the other hand, in the housing 210 of the second embodiment, the terminal receiving chambers 111 provided in the center is arranged in zigzag arrangement as mentioned above. For this reason, the terminal receiving chambers 111 provided in an upper side and lower side are arranged so as to deviate in the horizontal direction. As a result, in the housing 210 of the second embodiment, the above space Ar2 can be narrowed, and the space W5 between the receiving chamber groups 112 in the width direction (vertical direction in drawing) of the zigzag arrangement is reduced than the space W3 shown in FIG. 5A. Further, in the housing 210 of the second embodiment, the space W2 between the terminal receiving chambers 111 in the horizontal direction is narrowed than the space W1 shown in FIG. 4A as with the first embodiment described above. The housing 210 of the second embodiment can reduce the spaces W2 and W5 between the terminal receiving chambers 111 in the vertical and horizontal directions, and thereby the housing 210 can be more downsized. As a result, the connector can be more miniaturized.

Figure 6:
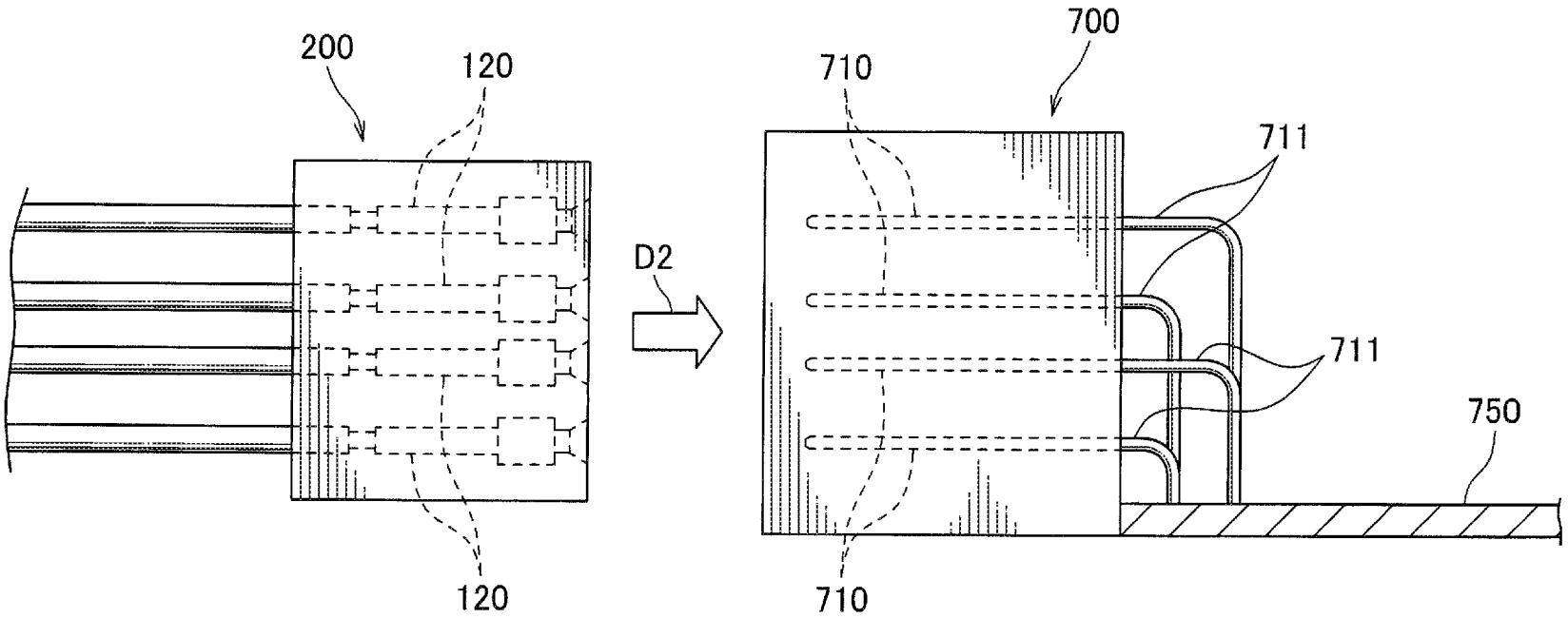
FIG. 6 is a view showing a substrate mounting type of a connector fitted to the connector of the second embodiment.
Figure 7:
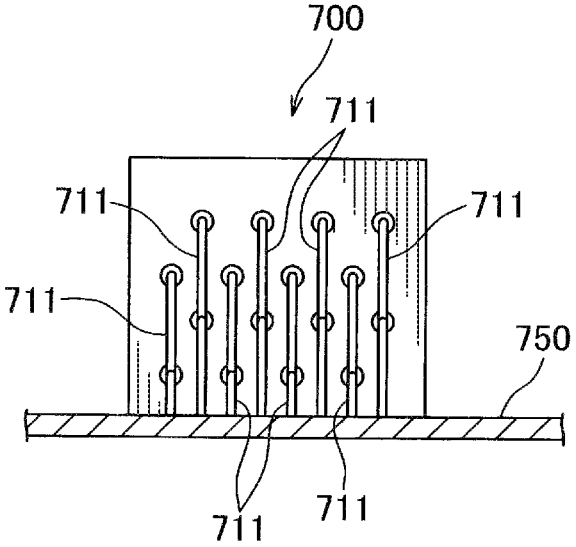
FIG. 7 is a view seeing the substrate mounting type of the connector shown in FIG. 6 from a substrate side.

In the embodiments of the present invention, a substrate mounting type of connector is considered as a mating connector. FIG. 6 is a view showing the substrate mounting type of connector which is fitted to the connector of the second embodiment. FIG. 7 is a view seeing the substrate mounting type of the connector shown in FIG. 6 from a substrate side. The connector 200 of the second embodiment is fitted to the substrate mounting type of the connector 700 shown in FIGS. 6 and 7 in a fitting direction being the in-plane direction of the substrate 750 as shown with an arrow D2 in FIG. 6.

In the substrate mounting type of the connector 700, one side of a male terminal 710 is fitted to the round terminal 120 in the connector 200 of the second embodiment, and an opposite side thereof is a connecting pin 711 connected to a substrate 750. The connecting pin 711 extends parallel to the substrate 750, and is bent at 90 degrees. Furthermore, the connecting pin 711 is connected to the substrate 750. As a result, the substrate 750 has an occupied space required for connection of the connecting pin 711 in the substrate mounting type of the connector 700. In this case, as shown in FIG. 5B, according to the connector 200 of the second embodiment that the axes 111*c* of the terminal receiving chamber 111 provided in two stages and disposed opposite to each other are arranged shifted in the horizontal direction and located in a zigzag arrangement, the occupied space on the substrate 750 of the substrate mounting type of the connector 700 can be reduced as mentioned below.

Figure 8B:
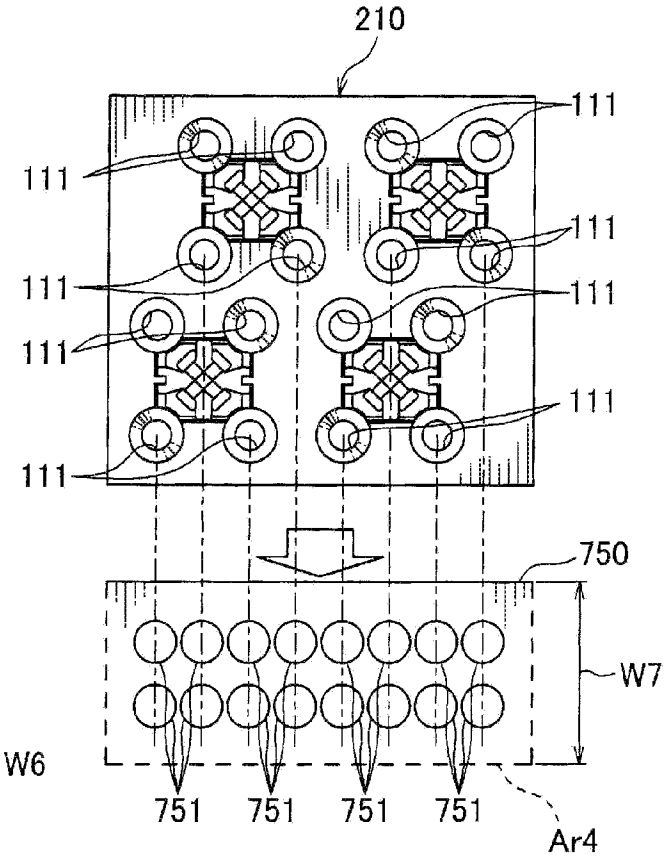
FIGS. 8A and 8B are views showing a state that an occupied space on the substrate in the substrate mounting type of the connector shown in FIGS. 6 and 7 is narrowed by the arrangement of the terminal receiving chamber in the connector fitted to the connector; and, FIG. 9 is a view showing one example of a conventional connector structure.
Figure 8A:
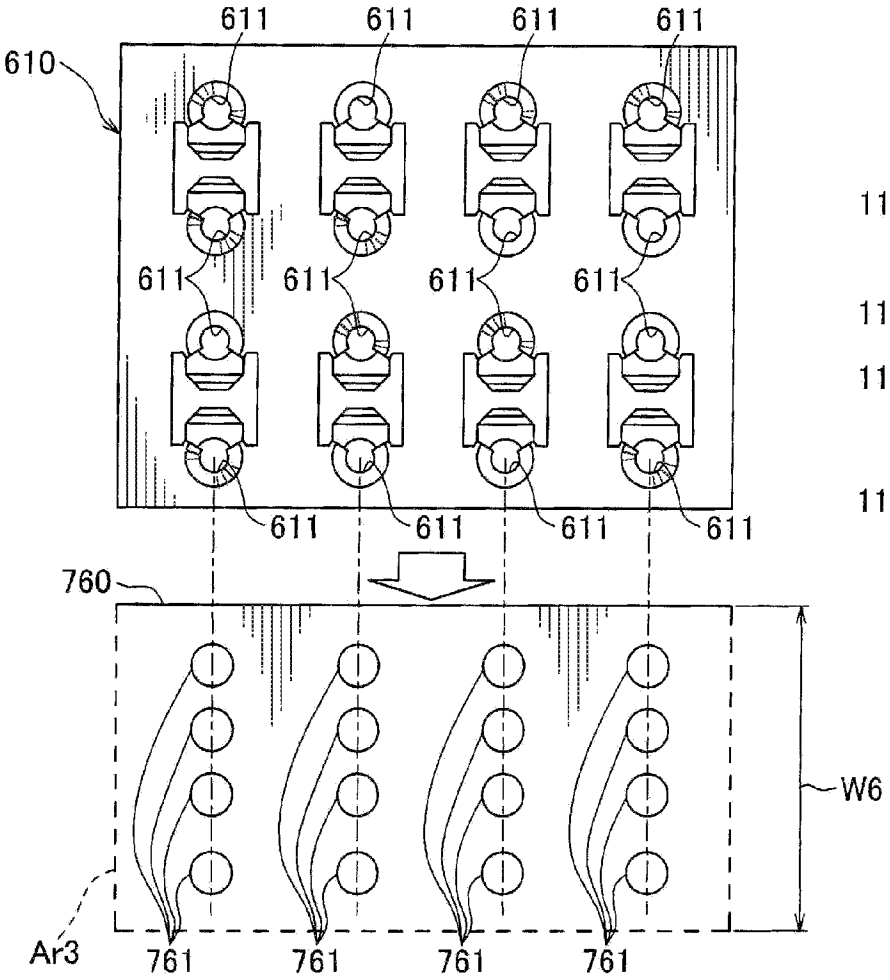

FIG. 8 is a view showing a state that the occupied space on the substrate in the substrate mounting type of the connector shown in FIGS. 6 and 7 is narrowed by the arrangement of the terminal receiving chamber in the connector fitted to the connector. FIG. 8A shows the housing 610 of the comparison example shown in FIG. 5 and the occupied space Ar3 on the substrate 760 required in the comparison example. Further, FIG. 8B shows the housing 210 of the second embodiment shown in FIG. 5 and the occupied space Ar4 on the substrate 750.

As shown in FIG. 8A, when the terminal receiving chambers 611 are arranged in a lattice point viewing from the axis direction, the mating male terminals in the substrate mounting type of the connector are also arranged in lattice points. Furthermore, the connecting pins extend parallel to each other, and are connected to the substrate 760. For this reason, the connecting points 761 on the substrate 760 are arranged in lattice points. Furthermore, the occupied space Ar3 of the width W6 according to the arrangement is occupied on the substrate 760.

On the other hand, in the connector 200 of the second embodiment, as shown in FIG. 8B, the horizontal direction parallel to the substrate 750 when fitted to the mating connector is adopted as a direction shifting the terminal receiving chamber 111. As a result, as shown in FIG. 7, the terminal of the horizontal direction in the substrate mounting type of the connector 700 can be arranged in a zigzag arrangement so that the terminals provided in the center of the housing are arranged shifted in the horizontal direction as with the terminal receiving chamber 111 of the second embodiment. The zigzag arrangement is a series arrangement of two rows facing each other, however the arrangement of the connecting points 751 on the substrate 750 in the horizontal direction can be arranged side by side in a row without a space in the vertical direction. As a result, the width W7 of the occupied space Ar4 on the substrate 750 can be reduced with a ½ of the occupied space Ar3 in the comparison example. Therefore, according to the second embodiment, it is possible to narrow the occupied space Ar4 on the substrate 750 to the half of the occupied space Ar3 in the comparison example.

The illustrated two embodiments of the present invention have been described for illustrative purposes only, and not by way of limiting the invention. Accordingly, the present invention can be implemented with various modifications made thereto within the scope of the present invention.

For example, in the above two embodiments, the quadrangular housings 110, 210 are shown as one example of the housing of the present invention. However, the housing of the present invention is not limited. For example, it may be formed in an arbitrary shape.

Furthermore, for example, in the above two embodiments, as one example of the housing of the present invention, the housings 110 and 210 which arrange the receiving chamber group 112 of two rows in the vertical and horizontal directions with a total of four groups are illustrated. However, the housing of the present invention is not limited thereto. Such as, one of the receiving chamber group may be provided, and a plurality of the receiving chamber groups other than four groups may be provided.

Furthermore, for example, in the above two embodiments, as one example of the receiving chamber group of the present invention, the receiving chamber groups 112 are illustrated. In the receiving chamber groups 112, four terminal receiving chambers 111 are arranged side by side so that the axes 111*c* are positioned at a vertex of the square Sg1, respectively. However, the receiving chamber groups of the present invention are not limited. For example, four terminal receiving chambers may be arranged side by side so that the axes are positioned at a vertex of a rectangle.

REFERENCE SIGNS LIST

100, 200 connector
110,210 housing
111 terminal receiving chamber
111*a* fitting hole
111*b* insertion/extraction hole
112 receiving chamber group
113 flexible lance
113*a* fixed end
113*b* free end
113*c* locking portion
114 lance body
120 round terminal (an example of terminal)
121 large-diameter portion
122 small-diameter portion
123 step

What is claimed is:

1. A connector comprising:

a terminal including a large-diameter portion and a small-diameter portion formed in cylindrical shape and continued in an axial direction; and a housing for receiving a plurality of the terminals, wherein the housing has:

a receiving chamber group including four terminal receiving chambers extending from one end of the housing toward the other end thereof and in which the terminal is inserted with the large-diameter portion as a leading end from an opening provided in the other end; and a lance body arranged to be surrounded by the four terminal receiving chambers, wherein each of the four terminal receiving chambers of the receiving chamber group is arranged so that each axis of the terminal receiving chambers is parallel to each other and is located on four vertexes of a square or rectangle when viewing from the axis direction, wherein the lance body is arranged corresponding to each the four terminal receiving chambers and integrally has four flexible lances extending in a longitudinal direction of the terminal receiving chamber, one end of each the flexible lance is formed to be a free end in the one end of the housing, wherein each the four flexible lances has a locking portion projecting into an inside of the terminal receiving chamber so as to be locked on a step between the large-diameter portion and the small-diameter portion in the terminal received in the corresponding terminal receiving chamber, and wherein each the four flexible lances is located in a diagonal line of the square or rectangle so that the free end is bent in a diagonal direction of the square or rectangle and the locking portion is locked or unlocked on the step when the terminal is inserted in the terminal receiving chamber or extracted therefrom.

2. The connector according to claim 1, wherein the free end of the flexible lance extends toward the one end of the housing beyond the step, and supports the large-diameter portion in the diagonal direction.

3. The connector according to claim 1, wherein a plurality of the receiving chamber groups are provided, one of the plurality of the receiving chamber groups and the other of the plurality of the receiving chamber groups are arranged opposite to each other with a space in one direction, and the axis of the terminal receiving chamber of the one of the plurality of the receiving chamber groups and the axis of the terminal receiving chamber of the other of the plurality of the receiving chamber groups are arranged so as to be shifted in a direction perpendicular to the one direction.

4. The connector according to claim 2, wherein a plurality of the receiving chamber groups are provided, one of the plurality of the receiving chamber groups and the other of the plurality of the receiving chamber groups are arranged opposite to each other with a space in one direction, and the axis of the terminal receiving chamber of the one of the plurality of the receiving chamber groups and the axis of the terminal receiving chamber of the other of the plurality of the receiving chamber groups are arranged so as to be shifted in a direction perpendicular to the one direction.

* * * * *